United States Patent [19]

Wenzel

[11] Patent Number: 4,541,810

[45] Date of Patent: Sep. 17, 1985

[54] SWIMMING APPARATUS

[76] Inventor: Clarence E. Wenzel, 12 Gwynne Rd., Melville, N.Y. 11747

[21] Appl. No.: 546,659

[22] Filed: Oct. 28, 1983

[51] Int. Cl.[4] ..... A63B 31/08

[52] U.S. Cl. ..... 441/64

[58] Field of Search ..... 441/61, 62, 63, 64, 441/55; 405/186; D21/239

[56] References Cited

U.S. PATENT DOCUMENTS

| | | | |
|---|---|---|---|
| 3,019,458 | 2/1962 | Barbieri | 441/64 |
| 3,411,165 | 11/1968 | Murdoch | 441/64 |
| 3,529,565 | 9/1970 | Iglesias | 441/64 |
| 3,987,509 | 10/1976 | Patterman | 441/64 |
| 4,055,174 | 10/1977 | Le Vasseur | 441/64 |
| 4,250,584 | 2/1981 | Korn | 441/61 |

FOREIGN PATENT DOCUMENTS

| | | | |
|---|---|---|---|
| 1085798 | 7/1960 | Fed. Rep. of Germany | 441/64 |
| 2506619 | 3/1982 | France | 441/64 |
| 272114 | 5/1970 | U.S.S.R. | 441/64 |

*Primary Examiner*—Trygve M. Blix

*Assistant Examiner*—Stephen P. Avila

*Attorney, Agent, or Firm*—Daniel Jay Tick

[57] ABSTRACT

Swimming apparatus for improved propulsion includes fluked foot flippers constructed to include a stiff load-bearing frame member in the leading edge of the fluke. As the flipper is pumped by the swimmer, a web secured to the frame member is caused to cup the flowing water by arching its surface. The flipper permits arching of the web and bending of the frame member both upward and downward, thereby creating a powerful stream of water propelled to the rear and resulting in a powerful propulsive forward thrust of the swimmer. The thrust is further enhanced by applying precisely formed hydrofoil cross-sectional or chordwise shaping to the fluke to accelerate the flow of water into the pocket. This flow also creates a lifting force which is in the direction of the fluke's motion and thus supports the kicking effort. In addition, spanwise hydrodynamic shaping serves to guide a greater volume of water into the pocket thereby further increasing the propulsive thrust.

11 Claims, 13 Drawing Figures

FIG. 8
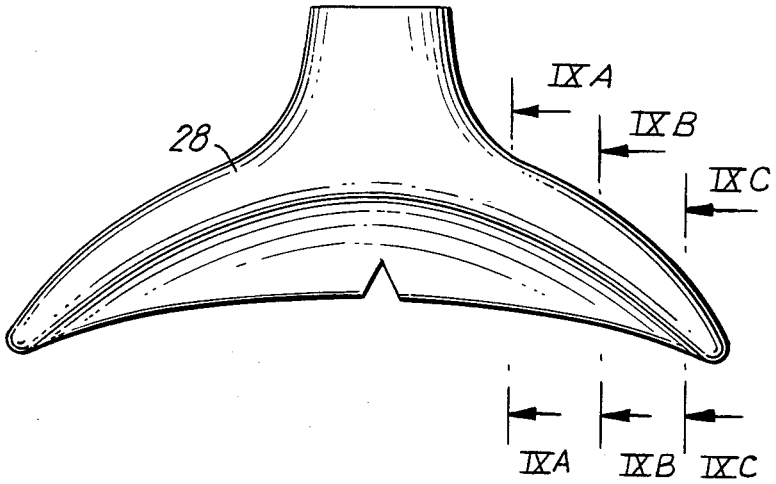
FIG. 9A
FIG. 9B
FIG. 9C
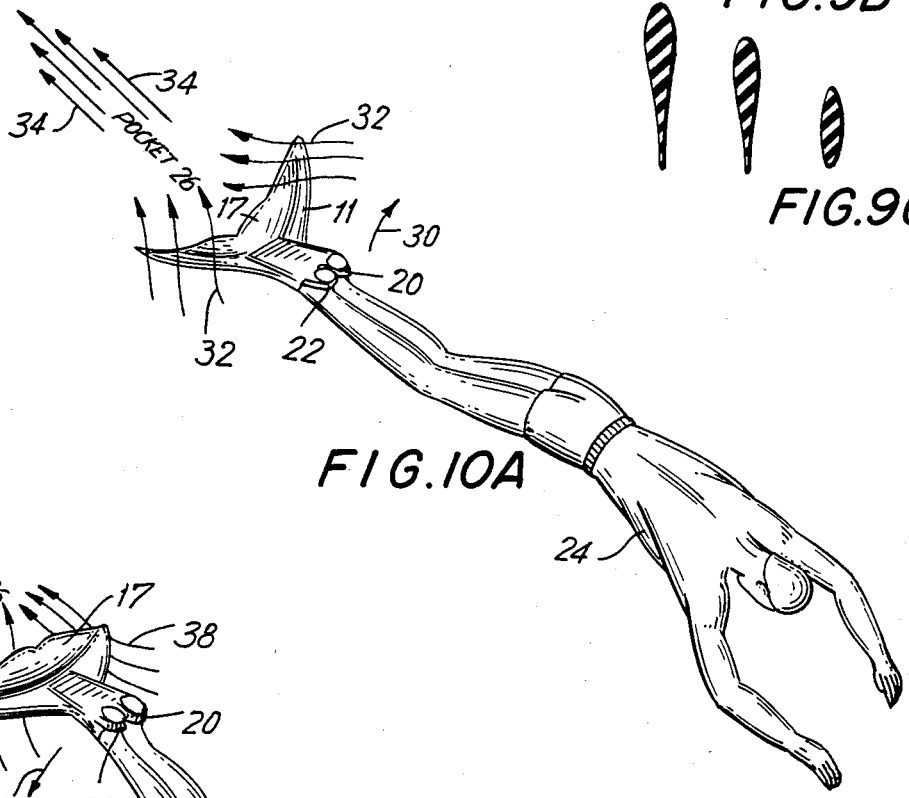
FIG. 10A
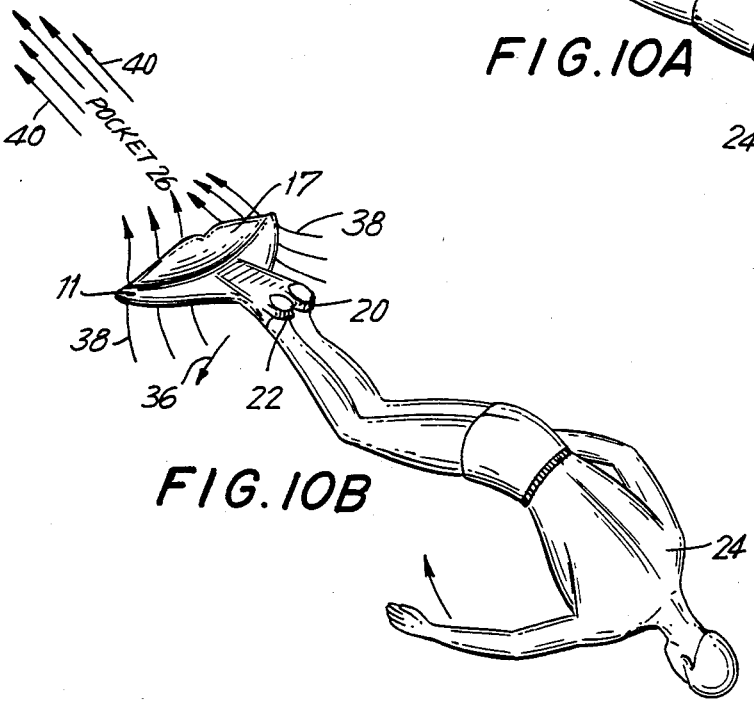
FIG. 10B

SWIMMING APPARATUS

BACKGROUND OF THE INVENTION

The present invention relates to swimming apparatus. More particularly, the invention relates to flipper type apparatus suitable for wearing on a swimmer's feet. The apparatus of the invention optimizes a swimmer's propulsion resulting from a given movement.

Numerous aquatic swimming aid devices have been proposed in the prior art. Several of these devices relate to foot or leg fitting flippers while others disclose upper torso suits and glove-type swimming appliances.

U.S. Pat. Nos. 3,934,290, 3,344,449 and 1,530,560 relate to lower body apparatus fitting over the legs of a swimmer in a mermaid-type arrangement. These patents include reference to detachable flukes and boot portions having both separable and unitary foot and leg portions.

Thus, U.S. Pat. No. 3,934,290, Le Vasseur, discloses a swimming system having a single fin for the feet with a large fluke and two foot openings leading to foot pockets separated by a cushion. A series of water directed openings extend rearward and outward from a line above the toe portions of the pockets diagonally through the fluke to a line near a tip of the fluke on a rearward portion of the fin. A fastening surrounds the fin near instep areas of the foot-receiving pockets. A leg sheath has a corresponding lower fastening, a cushioning divider between legs and an achilles cushion above a heel portion. A reinforced upper waist band fastens to a jacket portion with hand openings which overlie hand fins formed of flat circular plates with finger and palm cutouts mounted between two pieces of synthetic dolphin skin. The helmet with an annular neck encircling cushion completes the entire body covering with a synthetic dolphin skin exterior.

The foot fluke portion of Le Vasseur has a broad, laterally extended fluke, with a distal edge. Holes let water out of foot pockets in the foot-receiving portion. Port openings connect diagonal passageways with lower rearward ports. The foot fluke fin has a laterally extended fluke portion, which tapers outwardly and terminates in a curved distal edge. Foot-receiving pockets are divided centrally by a cushion. Openings provide access to the foot-receiving pockets in the foot mounting portion. Holes permit flow out of toe areas of pockets when feet are inserted in the pockets. A parallel row of plural port openings leads from an area of the fluke just forward of the toe through diagonal channels to rearward ports.

U.S. Pat. No. 3,344,449, Grilli, discloses a swimsuit in the form of a sock or bag of elasticized fabric or cloth having a tubular body tapering from one end to the other. The narrow end of the body of the swimsuit is closed forming a pocket or foot portion for the feet of the wearer. The pocket is formed with spaced perforations at opposite sides. A fin structure is attached to the pocket. The fin structure comprises a triangular-shaped body formed of two sheets to solid rubber, the sheets at the wide portion of the body being juxtaposed and secured together by adhesive and at the upper narrower portion being spaced apart providing a socket portion to receive the foot portion. The upper tapered portion is formed with spaced perforations aligned with the perforations in the foot portion, so that passages are provided across the socket portion of the fin structure. The wide portion of the body is curved at its bottom edge and indented centrally and is formed with curved laterally extending wing portions.

Hip mounted fins are described in U.S. Pat. No. 3,428,980, wherein the fins are designed to work against the feet in dolphin kicks.

U.S. Pat. Nos. 3,934,290, 2,313,979 and 1,049,488 disclose glove-type swimming appliances.

French patent No. 2,149,103, Frieri et al, discloses a rubber shoe shaped as a fin or flipper and reinforced with a high elasticity element of polyester resin reinforced with glass fibers.

U.S. Pat. No. 3,411,165, Murdoch, discloses a swim fin having a relatively thin, transversely bowed, non-stretched, bellied web which reversibly cups during swimming due to marginal portions flexibly secured to the front of a shoe-like member and to the inner portions of diverging inflexible forward extending ribs.

U.S. Pat. No. 3,529,565, Iglesias, discloses a dynafin accessory for use by scuba divers having a transmission bar adaptable for being positioned adjacent a front side of a swimmer. One end of the transmission bar is secured to a shoulder support and an opposite end of the transmission bar is secured to a fin assembly. The shoulder support is mountable over the swimmer's shoulders. The fin assembly is operated by said swimmer's feet.

None of the aforementioned patents discloses any of the load-bearing, resilient frame member of substantially arcuate configuration having two relatively stiff spaced ends and a common connecting portion, the frame member being sufficiently flexible to permit bending and twisting in response to an applied load, the substantially flexible, resilient webbing juxtaposed between the end legs and secured thereto, the webbing bowing in response to an applied load, or the foot-receiving pocket in the common connecting portion of the frame member for accommodating both feet of the swimmer of the apparatus of the invention, whereby in operation the apparatus captures a pocket of water in the flexible webbing thereby distorting the shape of the frame member and the webbing and propelling the water rearward in a narrow stream as the swimmer effects upward and downward foot motion.

Although some of the aforementioned references teach the use of a porpoise tail shaped flipper as as aid to aquatic propulsion, none of these patents discloses a flipper internal construction of the type of the invention, which provides maximum propulsive benefit. Since any given shape may be constructed to be rigid or flexible, those skilled in the art have heretofore been left unaided in designing flipper-type apparatus which provides strength and flexibility in the proper regions in order to maximize the propulsion advantages achievable through their use.

The principal object of the invention is to provide swimming apparatus which greatly increases a swimmer's propulsive thrust through the water.

An object of the invention is to provide swimming apparatus of simple structure, which is used with facility and considerably increases a swimmer's speed through the water.

Another object of the invention is to provide swimming apparatus having a selectively flexible flipper tail portion to permit bowing or arching of the webbing in both the upward and downward directions thereby greatly increasing the forward thrust of a swimmer.

Still another object of the invention is to provide swimming apparatus having a construction which permits a pumping motion by a swimmer to create an efficient water jet rearward thereby increasing the swimmer's speed.

Yet another object of the invention is to provide swimming apparatus of flipper type which is sufficiently resilient to trap water within its tail portion, and with the proper hydrofoil, propel the water efficiently to the rear thereby greatly increasing the forward thrust of a swimmer through the water.

BRIEF SUMMARY OF THE INVENTION

In accordance with the invention, swimming apparatus for increasing the propulsion of a swimmer comprises a load-bearing, resilient frame member of substantially arcuate configuration having two relatively stiff spaced ends and a common connecting portion. The frame member is sufficiently flexible to permit bending and twisting in response to an applied load. Substantially flexible, resilient webbing is juxtaposed between the ends and secured thereto, and bows or arches in response to an applied load. A foot-receiving pocket in the common connecting portion of the frame member accommodates both feet of the swimmer, whereby in operation the apparatus captures a pocket of water in said flexible webbing thereby distorting the shape of the frame member and the webbing and propelling the water rearward in a narrow stream as the swimmer effects upward and downward foot motion.

The frame member has a leading edge and the foot-receiving pocket is positioned well into the leading edge.

The webbing overlays the surface of the frame member to form a continuous coating along the surface of the apparatus.

The frame member consists of material of sufficiently compliant properties to permit bending and twisting of the ends as water is captured in the webbing.

The ends of the frame member bend upward and toward each other and each of the ends twists essentially about its axis.

The frame member has a cross-sectional hydrofoil configuration for providing lift in both kicking directions and for accelerating the flow of water into a pocket formed by bowing action of the webbing in motion.

The frame member has a spanwise hydrodynamic configuration for enhancing the entrapment of water and facilitating the flow of water into a pocket formed by bowing action of the webbing in motion and into a concentrated jet stream.

The frame member and the webbing consist of material sufficiently resilient to hurl water captured in the webbing rearward to impart a pulse of propulsive force to the swimmer.

The frame member is composed of aluminum, spring steel, or the like.

The webbing may consist of a plastic material or rubber.

In accordance with the invention, swimming apparatus for increasing the propulsive thrust of a swimmer comprises a generally Y-shaped frame member of high strength, ductile material having a high resiliency. The frame member has a pair of forked portions spaced from each other at their free ends. Fluked webbing is connected between the forked portions of the frame member. The webbing consists of flexible plastic material which permits bowing between the forked portions when the webbing encounters fluid resistance. A foot-receiving pocket in the frame member at the juncture of the forked portions accommodates both feet of the swimmer.

The foot-receiving pocket is encompassed within a housing integrally formed as a portion of the frame member.

The housing has a smooth and fluid construction for minimizing hydrofoil drag.

In accordance with the invention, swimming apparatus for increasing the propulsive thrust of a swimmer comprises a plastic member formed in the general shape of a porpoise tail having a tail root, a leading edge portion on both sides of the tail root, the leading edge portion having a hydrofoil cross-section, a webbing portion extending between the tail root and leading edge portion, the tail root and leading edge portion consisting of material stiffer than the webbing portion and the webbing portion consisting of material more flexible than that of the tail root and leading edge portion for permitting bowing of the webbing portion and deformation of the leading edge portion as fluid resistance is encountered, and means in the tail root for accommodating both feet of the swimmer. The webbing and leading edge portions are sufficiently resilient to return to their original shape during pumping motion of the feet of the swimmer thereby imparting a rearward velocity to fluid captured in the webbing and a forward thrust to the swimmer.

BRIEF DESCRIPTION OF THE DRAWINGS

In order that the invention may be readily carried into effect, it will now be described with reference to the accompanying drawings, wherein:

FIG. 8 is a top elevational view, on an enlarged scale, of another embodiment of the swimming apparatus of the invention;

FIG. 9A is a cross-sectional view, taken along the lines IXA—IXA, of FIG. 8;

FIG. 9B is a cross-sectional view, taken along the lines IXB'IXB, of FIG. 8;

FIG. 9C is a cross-sectional view, taken along the lines IXC—IXC, of FIG. 8; and FIGS. 1OA and 10B are perspective views illustrating the swimming apparatus of the invention in use, FIG. 1OA showing the swimmer before the kick and FIG. 1OB showing the swimmer after the kick.

DETAILED DESCRIPTION OF PREFERRED EMBODIMENTS

Figure 1:
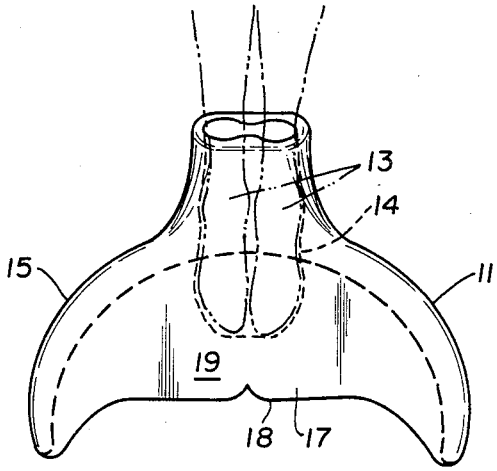
FIG. 1 is a bottom elevational view of an embodiment of the swimming apparatus of the invention.

FIG. 1 shows an embodiment of the swimming apparatus of the invention fitted on the feet of a swimmer. The swimming apparatus of the invention comprises a flipper 11 formed in the general shape of a porpoise tail and adapted to accommodate both feet 13 of the swimmer or user snugly within a foot-receiving pocket 14 to permit movement of the flipper 11 in water with good leverage and without said flipper slipping off said feet. Fastening means such as straps 20 and 22 (FIGS. 10A and 10B) may also be utilized to insure that the user's feet remain securely within the pocket 14 as said user pumps his legs. The foot-receiving pocket 14 is positioned well into the leading edge of the flipper 11.

The swimming apparatus or flipper assembly of the invention includes a generally Y-shaped frame, support, or horn member 15 (FIGS. 1, 3 and 4) which is generally constructed in an arcuate or wishbone fashion. The frame member 15 provides the basic structural integrity for the flipper. The frame member 15 has a carefully selected hydrofoil cross-section, as shown in FIGS. 9A, 9B and 9C.

Figure 4:
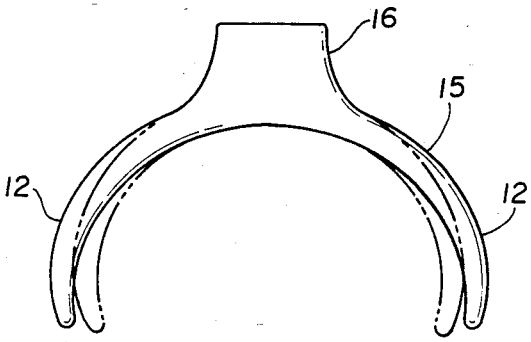
FIG. 4 is a top view of an embodiment of the basic frame member of the swimming apparatus of the invention.

Webbing 17 (FIG. 1) covers the frame member 15 and is shaped to form the desired fluke pattern at the trailing edge of said webbing between the frame, support, or horn ends 12 (FIG. 4). The thickness of the webbing 17 is selected to permit sufficient flexibility to effect bowing, arching, ballooning, or cupping of said webbing as the flipper 11 is moved through the water. As the user's legs are pumped upward or downward, the webbing material 17 within a flipper fan section 19 encounters sufficient water resistance to force a bowing, arching, ballooning or cupping of the fan between the ends 12 of the more rigid frame member 15. With the continuation of the pumping movement, the fan section 19 returns to its normal position and, in fact, will overshoot its normal position to arch, bow, or cup in the opposite direction.

The frame, support, or horn member 15, shown most clearly in FIG. 4, has two forked leg portions or ends 12 and a common or root portion 16. Structurally, the frame member 15 is sufficiently resilient to permit a complex bending and twisting of said frame member as the fan portion 19 of the webbing 17 encounters fluid resistance. More particularly, the ends 12 of the frame member 15 bend upward and toward each other and each of said ends twists essentially about its axis. The resiliency of the frame member 15 serves to return said frame member to its normal position as the pumping stroke is continued by the swimmer.

Plastic materials such as blends RP-6414, RP-6405 or Thane (trademark) produced by Smooth-on Corporation are suitable as the webbing material 17. These plastics are preferably injection molded into the desired shape. The frame member 15 may be formed of resilient metallic sheet or tubing material such as, for example, aluminum or spring steel. Holes may be drilled into the frame member 15 to form a better anchor with the plastic material injected about said frame member.

In an alternative embodiment, the need for a separate frame member may be eliminated and the swimming apparatus may be an integral plastic structure. Such structure may assume the aforedescribed shape of the separable frame member 15. Plastic materials such as those hereinbefore described may be injected into a mold to form thicker hydrofoil portions along the leading edge with thinner, more flexible, regions in the webbing area. As one skilled in the art will recognize, there are a variety of techniques and materials which will produce an integral plastic article having varying degrees of flexibility in selected regions.

Cupping, arching or bowing action of the webbing 17 creates a slingshot action of the frame or support member 15 and said webbing which increases the velocity of the water forced to the rear by the flipper action. The forward propulsive thrust or velocity of the swimmer 24 (FIGS. 10A and 10B) is thereby increased, improving his or her overall swimming efficiency.

The hydrofoil cross-section of the frame member 15 essentially has the shape of a polywog, as shown in FIGS. 9A, 9B and 9C and functions to accelerate the flow of water into a pocket 26 (FIGS. 10A and 10B), helps to trap more water and to concentrate it in a narrow stream or jet and helps approach the optimum performance of a dolphin's fluke. The hydrofoil cross-sectional configuration also increases the lift in the direction of pumping motion of the swimmer 24 thereby easing such motion, as shown in FIGS. 1OA and 1OB.

The creation of the improved thrust constitutes the fundamental novelty of the invention. The flipper assembly of the invention, having a stiff leading edge portion 15 and a flexible webbing fan section 19 capable of cupping, bowing or arching when moved in the normal manner, increases the discharged water velocity, resulting in improved forward thrust of the swimmer.

Figure 2:
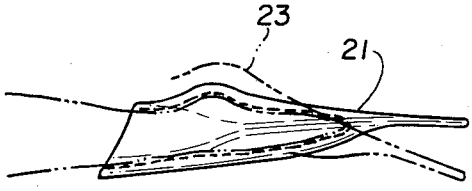
FIG. 2 is a side view of the embodiment of FIG. 1 in a horizontal plane.

FIG. 2 is a side view of the embodiment of FIG. 1. As shown in solid lines 21 in FIG. 2, the construction of the flipper 11 may be contoured to closely match the profile of the user's feet. Alternatively, the profile of the flipper 11 may be less contoured effecting a more forward center of gravity. Molding and finishing requirements are important and play a dominant role in the precise construction selected. Design parameters may vary about the basic requirements for a resilient and flexible fan section 19 which may be cupped, arched, or bowed within a relatively rigid frame member 15.

The broken line 23 in FIG. 2 illustrates a change in the profile of the flipper 11 as a downward pumping motion is effected by the swimmer 24. The higher profile is representative of the upward bending or bowing of the frame member 15 and the webbing material 17 as fluid resistance is encountered.

Figure 3:
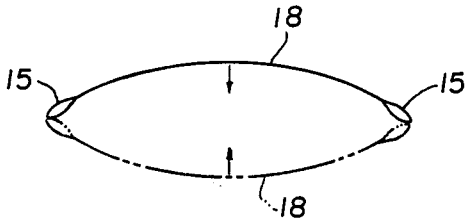
FIG. 3 is a schematic diagram showing the arching of the webbing material and the twisting of the frame member, as viewed from the rear.

FIG. 3 is a rear view of the fluke or trailing edge 18 (FIGS. 1 and 3) of the flipper assembly, illustrating the cupping, bowing or arching action of the flexible webbing 17 between the frame or horn ends 12. As the user or swimmer 24 pumps his or her feet upward, the fluke 18 is displaced in a downward direction, as shown by the broken lines in FIG. 3. Downward movement of the flipper 11 moves the fluke 18 to arch in the manner shown by the solid lines in FIG. 3. FIG. 3 also illustrates the twisting of the horn ends 12. Depending upon the direction of the pumping motion, the horn ends 12 may be twisted in a clockwise or counterclockwise direction essentially about their axes. Inward bending of the frame member 15 is shown by broken lines in FIG. 4. Inward and upward bending and twisting of the frame member 15 may occur during each pumping motion effected.

The basic frame or horn member 15 is illustrated in FIG. 4. As the flipper 11 starts down from the high point of its pumping stroke, the frame member 15, due to its design, permits bending both upward and inward while twisting upwards along the inside edge. This flexibility permits the flipper fan section 19 to arch and increases the slingshot effect, imparting increased velocity to the captured water. Thus, the swimming apparatus of the invention traps a body of water within the fan section 19 and, with the proper hydrofoil cross-sectional configuration (FIGS. 9A, 9B and 9C), propels the water efficiently to the rear, as shown in FIG. 1OB.

In one embodiment, the material of the frame or horn member 15 is composed of lightweight tapered aluminum tubing construction having a diameter of about one inch at its widest portion. The fan section 19 may be formed of plastic materials such as Ren:C:0-Thane (trademark), produced by Smooth-on Corporation or rubber compounds.

Figure 5:
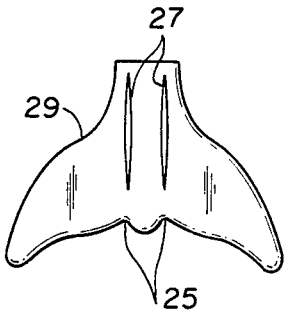
FIGS. 5, 6 and 7 are top elevational views of various other embodiments of the swimming apparatus of the invention, illustrating different fluke and webbing constructions.
Figure 6:
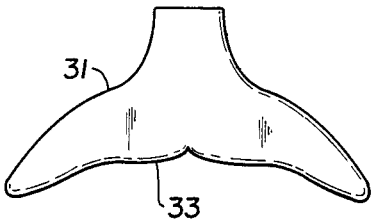
Figure 7:
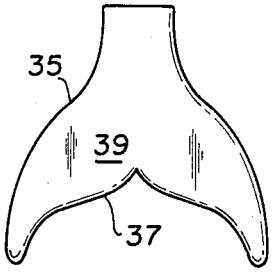

FIGS. 5, 6 and 7 show different design variations or embodiments of the flipper 11. The embodiment of the flipper 29 of FIG. 5 includes a double slotted fluke construction. The flipper 29 has a pair of indentations 25 in the fluke trailing edge of the flipper assembly. Dorsal type fins 27 extend substantially longitudinally from the flipper 29.

FIG. 6 illustrates an embodiment of the flipper 31 having a wide fluke 33. The fluke trailing edge 33 extends considerably longer, in the embodiment of FIG. 6, than in the other embodiments. The frame member of the embodiment of FIG. 6 is thus designed for a broader expanse than in the other embodiments.

Aside from extending the width of the fluke, the invention may also be modified by extending the web length. This is illustrated in the embodiment of FIG. 7, wherein the flipper 35 includes a long web 39. The fluke trailing edge 37 of the embodiment of FIG. 7 is steeper than in the other embodiments, although a more straight edge may be used with the longer web, if desired.

FIGS. 9A, 9B and 9C are cross-sectional views taken at different parts of an embodiment of a flipper 28 of the invention in order to illustrate the preferred hydrofoil configuration for maximum efficiency of the swimming apparatus of the invention.

FIG. 1OA shows the swimmer 24 before reversal of kicking, in the upward direction, shown by an arrow 30. The lift is also in the direction of the arrow 30, so that the water flow is illustrated by arrows 32 and 34. The web 17 of the flipper 11 arches in the manner of the broken lines in FIG. 3. FIG. 10B shows the swimmer 24 after reversal of kicking, in the downward direction, shown by an arrow 36. The lift is also in the direction of the arrow 36, so that the water flow is illustrated by arrows 38 and 40. The web 17 of the flipper 11 arches in the manner of the solid line in FIG. 3.

FIGS. 10A and 10B illustrate how the swimming apparatus of the invention flexes to guide water into the pocket 26 to create a powerful water jet propulsive force. The cross-sectional hydrofoil configuration of the flipper 11 provides lift in both kicking directions and accelerates the flow of water into the pocket 26, which is formed by the bowing or arching action of the webbing 17 in motion. The flipper 11 has a spanwise hydrodynamic configuration for enhancing the entrapment of water and facilitating the flow of water into the pocket 26 and into a concentrated jet stream.

It will be obvious to those skilled in the art that various other modifications in the shape of the flipper may be made in order to minimize fluid dynamic drag. Likewise, variations of materials and the thickness thereof will affect the velocity of the stream of water which is pulsed to the rear by the cupping, bowing, or arching action of the flipper.

The objects and advantages of the invention are accomplished by the described flipper construction, which is stiff yet selectively flexible to have a relatively stiff leading edge and a more flexible webbing. The thickness and taper of the webbing may be selected with regard to the particular materials used in the structure and their characteristic flexibility. The material of the frame member should also be somewhat flexible to permit some degree of bending and twisting to permit the webbing to fully arch, bow or cup.

Spongy ankle socks may be incorporated in the interior of flipper apparatus to soften the interface between the feet of the user and the inner surface of the flipper.

The disclosed embodiments and other modifications and variations, such as those regarding the surface texture, buoyancy, angles of incidence, edge sweep and location of the foot pocket with respect to the fluke, fall within the scope of the invention, which is intended to be limited only by the appended claims which follow. Thus, although the foot pocket is shown in FIGS. 10A and 10B as being essentially for both feet of the swimmer in generally parallel relation with each other, it may be shaped to accommodate the feet of the swimmer in "pigeon-toed" relation with the toes of both feet closer to each other than the heels of the feet.

I claim:

1. Swimming apparatus for increasing the propulsive thrust of a swimmer, said apparatus comprising a member fully encompassed at the foot area of the swimmer, said member having a tail root, forked leg portions joined at said tail root, a webbing portion extending between said tail root and a trailing edge portion, said forked leg and webbing portions forming a hydrofoil, said tail root and forked leg portions consisting of material stiffer than said webbing portion, said webbing portion consisting of flexible material for permitting bowing and deformation as fluid resistance is encountered, a foot receiving pocket formed through said tail root for accommodating both feet of the swimmer, said webbing and trailing edge portions being sufficiently resilient to return to their original shape during pumping motion of the swimmer's feet thereby imparting a rearward velocity to fluid captured in said webbing and a forward thrust to said swimmer, and said foot receiving pocket extending into said webbing portion, said member further having a centerline and being formed in the general shape of a porpoise tail, said trailing edge having outer concave portions and inner convex portions symmetrically arranged with respect to the member centerline, dorsal type fins extending from said tail root to the webbing portion symmetrically arranged with respect to the member centerline, the fins being parallel and spaced apart at a width equal to the central convex portion width, said member further having a smooth and fluid construction for minimizing hydrofoil drag.

2. Swimming apparatus as claimed in claim 1, wherein said tail root and leg portions of said member are generally Y-shaped.

3. Swimming apparatus as claimed in claim 1, wherein said member has a cross-sectional hydrofoil configuration for providing lift in both kicking directions of the swimmer's feet.

4. Swimming apparatus as claimed in claim 1, wherein said webbing overlays the surface of said member to form a continuous coating along the surface of said apparatus.

5. Swimming apparatus as claimed in claim 1, wherein said member has spaced ends and consists of material of sufficiently compliant properties to permit bending and twisting of said ends as water is captured in said webbing.

6. Swimming apparatus as claimed in claim 1, wherein said member has a spanwise hydrodynamic configuration for enhancing the entrapment of water and facilitating the flow of water into a pocket formed by bowing action of said webbing in motion and into a concentrated jet stream.

7. Swimming apparatus as claimed in claim 1, wherein said tail root and leg portions and said webbing of said member consist of material sufficiently resilient to hurl water captured in said webbing rearward to impart a pulse of propulsive force to the swimmer.

8. Swimming apparatus as claimed in claim 1, wherein the tail root and leg portions of said member are composed of aluminum.

9. Swimming apparatus as claimed in claim 1, wherein the tail root and leg portions of said member are composed of spring steel.

10. Swimming apparatus as claimed in claim 1, wherein said webbing consists of a plastic material.

11. Swimming apparatus as claimed in claim 1, wherein said webbing consists of rubber.

* * * * *